United States Patent [19]

Granet

[11] 4,242,965

[45] Jan. 6, 1981

[54] CARRIER CONVEYOR

[76] Inventor: Alfred Granet, 7, Rue de Clos de Laroche, 86000 Poitiers, France

[21] Appl. No.: 12,604

[22] Filed: Feb. 15, 1979

[30] Foreign Application Priority Data

Feb. 17, 1978 [FR] France ..... 78 04602

[51] Int. Cl.[3] ..... B65G 17/00

[52] U.S. Cl. ..... 104/96; 104/130; 104/172 R; 104/172 C

[58] Field of Search ..... 104/170, 130, 172 R, 104/172 C, 96

[56] References Cited

U.S. PATENT DOCUMENTS

| | | | |
|---|---|---|---|
| 1,124,273 | 1/1915 | Bernheim | 104/170 |
| 3,581,670 | 6/1971 | Larivee | 104/170 |

FOREIGN PATENT DOCUMENTS

| | | |
|---|---|---|
| 1239999 | 7/1960 | France . |
| 2028057 | 9/1970 | France . |

*Primary Examiner*—Richard A. Bertsch
*Attorney, Agent, or Firm*—Abraham A. Saffitz

[57] ABSTRACT

A carrier conveyor comprising a main runway and a secondary runway each including a chain to which are secured stationary lugs for continuously driving carriers on a runway. A first auxiliary way includes a chain which is arranged to be moved in synchronism with the main chain and has lugs for driving carriers from a waiting position of the secondary way to the main way. Each retractable lug is returned by a spring to an engaged position for driving a carrier. A second auxiliary runway includes a chain which is arranged to be moved in synchronism with the main chain and has lugs for driving carriers from the main way to a stop position of the second auxiliary runway upstream of the secondary runway. A first electromechanical transfer device transfers a carrier from the waiting position onto the first auxiliary runway by an engaged lug of the first auxiliary chain. Movable means disengages selectively the retractable lugs of the first auxiliary chain from the carrier path when no carrier is to be transferred. A retractable lug at the disengaged position is not in contact with carriers at the waiting position. A second electromechanical transfer device transfers a carrier from the stop position to the secondary way. It comprises pivotable means which stops at the stop position a carrier previously driven by the second auxiliary chain, and means slidable along and retractable from the carrier path which pushes the stopped carrier between two stationary lugs of the secondary chain and which simultaneously pushes and disengages the pivotable stopping means from the carrier path.

11 Claims, 10 Drawing Figures

CARRIER CONVEYOR

BACKGROUND OF THE INVENTION

1. Field of the Invention

The present invention relates to a carrier conveyor comprising a main way for continuously driving carriers, a secondary way for stocking carriers and at least an auxiliary way located in the carrier transfer region between the main way and the secondary way. More particularly, it concerns a first transfer device for transferring a carrier from a waiting position in the secondary way to the main way via a first auxiliary way having retractable lugs and a second transfer device for transferring a carrier from a stop position to the secondary way via a second auxiliary way between the main way and the secondary way.

2. Description of the Prior Art

The French Pat. No. 1,239,999 discloses a stop device which stops carriers of an overhead conveyor. The carriers are driven by means of an endless chain provided with retractable lugs. The stop device is located in the region of the waiting position and ensures the stopping of carriers with predetermined spaces which correspond to the space occupied by the loads of the carriers.

The lower portion of each retractable lug is shaped as an inclined slope so as to enable the temporary stop of carriers without stopping the operation of the endless chain. The chain provided with retractable lugs advances even is the carriers are stopped by an adequate stop organ which is disengageable from the path followed by the carriers. In fact, the retractable lugs driven by the chain have their inclined slopes which slide along stops secured to the carrier bodies and which compress the release springs of the lugs at the disengaged position.

An overhead conveyor having a chain provided with retractable lugs is also described in the French Pat. No. 2,028,057. Each lug body comprises at least an inclined slope which come progressively into contact with stops fixed to the carrier bodies by means of the progressive space decrease between the driving chain and the carrier runway.

In accordance with the French Pat. No. 1,239,999, the stopping device includes the stop organ and a plurality of pedals which are disposed successively along the path followed by the carriers and upstream of the stop organ. Each pedal is mounted for rotation around a stationary shaft and is released on the carrier path by a return spring. At this disengaged position, the pedal does not stop a carrier. The first carrier upstream of the waiting position is driven by a retractable lug of the chain, causes the pivoting of the first pedal which is located upstream of the stop organ and abuts the stop organ. At this instant, the front portion of the first pedal pivots under the control of the return spring and is applied against the back roller of the first carrier body so that the first carrier is immobilized between the stop organ and the first pedal. The back portion of the first pedal downstream of the second following carrier stops the advancing of the second carrier and has the same rule as the stop organ for the first carrier. The stopping of other following carriers is carried out in a similar manner. Thus the stopping of carriers is accomplished without suspending the chain move since the retractable lugs are disengaged or retracted by sliding on the carrier stops without driving the carriers.

When the stop organ is disengaged, the first carrier is driven from the waiting position by a lug at the engaged position which come into contact with the stop of the first carrier. The first pedal is disengaged from the carrier path by means of the return spring and enables the advancing of the second carrier. This second carrier is driven by the following engaged lug which is disengaged when the second carrier is stopped by the stop organ.

During operation, this type of transfer device for an overhead carrier conveyor causes damages and an excessive abnormal wear of retractable lugs and carriers which are subjected to excessive stress. There is also a risk that the carriers will jam in the region of the waiting position, inter alia as result of a stoppage of the chain or occasional incomplete disengagement of the retractable lugs or, in general, the breaking or deforming of the retractable lugs.

In general, the operation of this type of transfer device requires frequent repairs and maintenance and causes rapid and systematic damages in the driving chain of the carriers and considerably reduces the reliability of the conveyor.

OBJECTS OF THE INVENTION

The main object of this invention is to provide a carrier conveyor in which a first transfer device for transferring carriers from the secondary way to the main way enables the selective disengagement of the retractable lugs of the first auxiliary chain and in which the second transfer device for transferring carriers from main way to secondary way enables to stop and to push the carriers conveyed by the second auxiliary chain.

Another object of this invention is to eliminate the excessive wear of the retractable lugs of the first auxiliary chain during the transfer operation.

A still another object of this invention is to provide a second transfer device with a more simplified and less costly structure.

A further object of this invention is to provide a second transfer device the stopping and pushing operations of which are not dependent upon the type of fixed or retractable lugs of the second auxiliary chain.

SUMMARY OF THE INVENTION

In accordance with the aforementioned objects, the first transfer device transfers a carrier from the waiting position of the secondary way into the runway of the first auxiliary way by an engaged lug of the first auxiliary chain. First electromechanical means of the first transfer device disengages selectively the retractable lugs of the first auxiliary chain from the path followed by the carriers when no carrier is to be transferred, a retractable lug at the disengaged position being not into contact with carriers at the waiting position.

The second transfer device comprises a second electromechanical means for transferring a carrier from the stop position downstream of the second auxiliary runway to said secondary way. The second electromechanical means includes pivotable means for stopping at the stop position a carrier previously driven by the second auxiliary chain and means slidable along and retractable from the path followed by the carriers upstream of the stop position for pushing the stopped carrier into secondary runway between two stationary lugs of the secondary chain and simultaneously for pushing and disengaging the pivotable stopping means from said path followed by the carriers.

BRIEF DESCRIPTION OF THE DRAWING

Other advantages of the present invention will be apparent from the more particular following description of a preferred embodiment with reference to the accompanying drawing, in which.

DESCRIPTION OF THE PREFERRED EMBODIMENT

Figure 1:
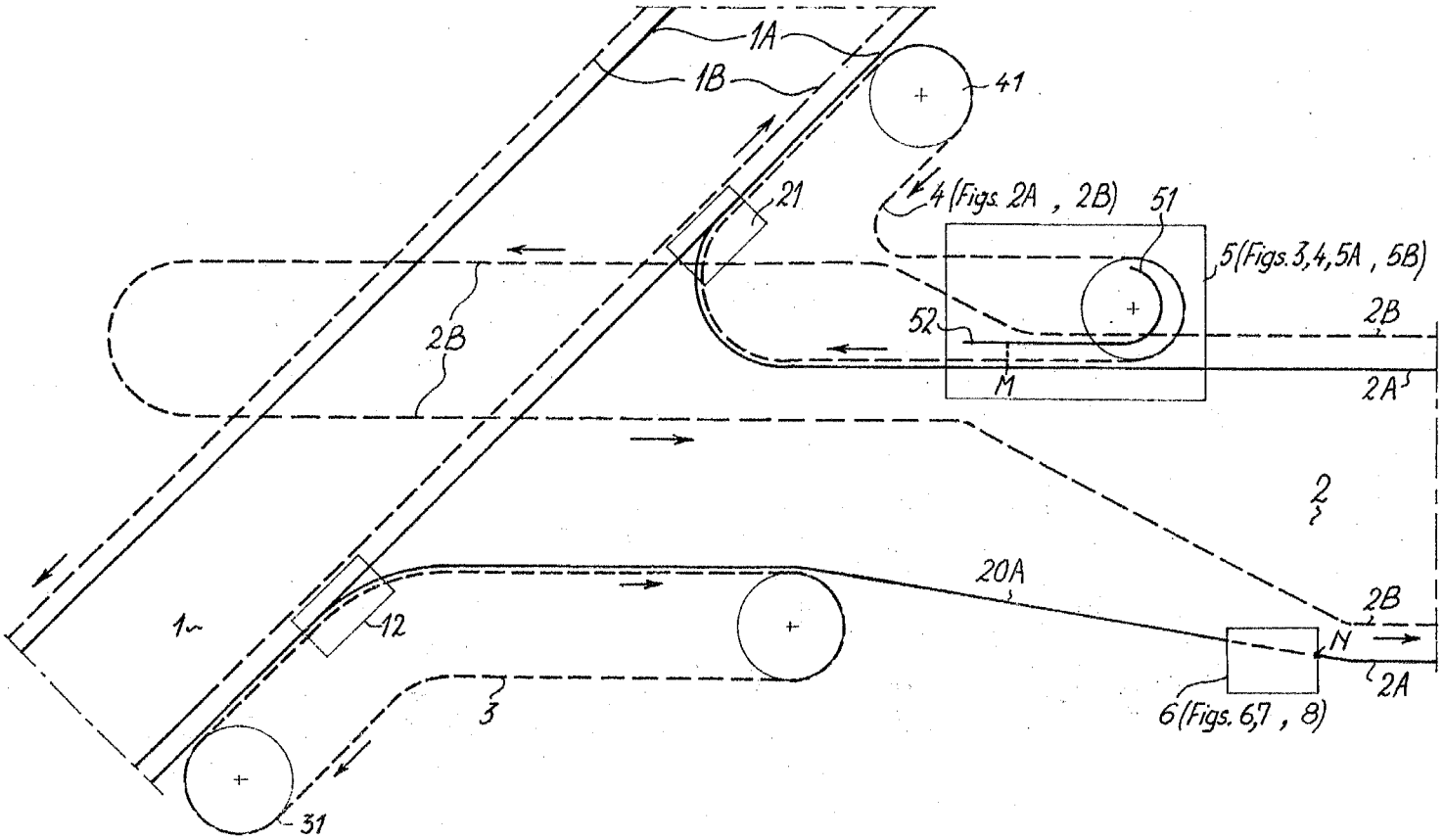
FIG. 1 is a structural diagram of the transfer regions of an overhead conveyor comprising first and second devices embodying the invention.

FIG. 1 shows a schematic diagram of the functional structure of carrier transfer regions in an overhead conveyor between a bidirectional main carrier conveying way 1 and a bidirectional secondary carrier conveying way 2 which ensures the carrier stockage.

Each of the main way and the secondary way comprises a railway or runway 1A or 2A for the carriers and a driving chain 1B or 2B comprising stationary lugs (shown in short broken lines) parallel to the runway and disposed substantially above it. According to the invention, the carriers need not be engaged during transfer operations, but only if and when they are parked at desired positions on the chains.

Transfers in either direction between the main and secondary ways are brought about in known manner via a first auxiliary chain 4 and a second auxiliary chain 3 which are driven at the same speed as the main chain 1B and have lugs distributed opposite the lugs on the main chain near electrically controlled shunting stations 12,21 between runways 1A and 2A. Electric control devices control the mechanical transfert of carriers between the runways 1A and 2A and also detect the marking on the carriers which, when decoded, ensure that when a first carrier is transferred from the way 1 to the way 2 by the auxiliary chain 3, a second carrier is transferred from the way 2 to the way 1 by the auxiliary chain 4, and takes the place of the first carrier in way 1. Furthermore, in order to ensure the carrier transfer between the chain 2B of the secondary way 2 and the auxiliary chains 3 and 4, the chains 2B and 3 are disengaged at M and N in vertical alignment with the secondary runway 2A. At M the carriers are in waiting position for transfer from the secondary way to the main way and in front of a first carrier transfer device 5. For the transfer from the main way 1 to the secondary way 2, the carriers previously driven by the second auxiliary chain 3 are descending by gravity down an inclined portion 20A of the auxiliary runway 2A which conveys them to a second carrier transfer device 6 which stops the carriers at the stop position N and inserts them between two stationary lugs on the secondary chain 2B.

The electric and electronic control devices for transferring the carriers from the conveyor do not belong to the scope of this invention and will not be described.

Figure 2A:
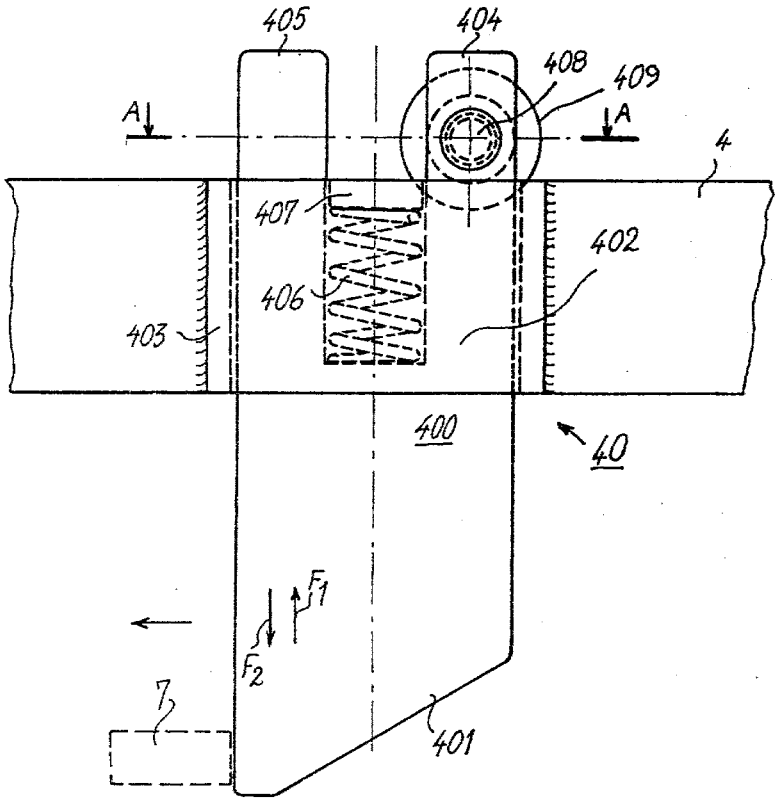
FIG. 2A is a top view of a retractable lug of the first auxiliary chain.
Figure 2B:
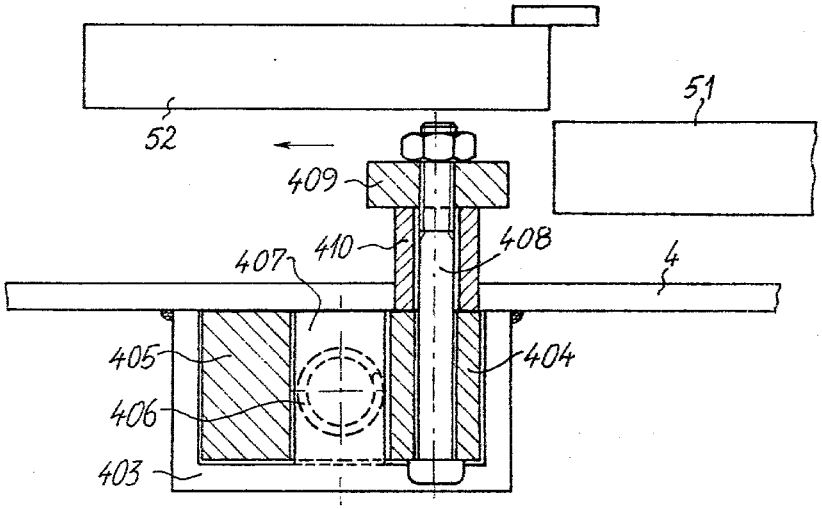
FIG. 2B is a sectional view along line A—A in FIG. 2A.

FIGS. 2A and 2B show a retractable lug 40 on the first auxiliary chain 4 according to the invention when the lug 40 is in the engaged position for driving a carrier C. The lug 40 comprises a horizontally elongated parallelepipedal body 400 the upstream end of which has an inclined surface 401 on the side outside the loop on the first auxiliary chain 4. The other downstream end of the body 400 is adapted to drive the carrier C. The body 400 of the lug 40 has also an U-shaped end 402 on the side inside the loop on the first auxiliary chain 4. The lug 40 is slidably mounted in a slideway 403 having an U-shaped vertical section and welded to the chain 4.

A compression spring 406 is inserted between the two arms 404 and 405 of the U-shaped end 402. The spring 406 is compressed between the bottom of the U-shaped end 402 and a vertically bent part 407 of the slideway 403. A vertical shaft 408 is transversely secured to the rear arm 404. A small roller 409 is rotatably mounted on the shaft 408 and separated from the lug body 400 by an annular cross-member 410. As shown in FIG. 2B, the cross-member 410 abuts the inner surface of slideway 403 when the spring 406 extends and the outside end 401 is in the position driving the carrier C. When the lug 40 is disengaged or retracted, the cross-member 410 is released from the inner surface of the slideway 403 and moves towards the interior of the loop on the first auxiliary chain 4 by means of a disengaging slope of the first transfer device 5, as explained hereinafter with reference to FIGS. 3 to 5.

As shown in FIG. 1, the first transfer device 5, whereby carriers waiting in the secondary way 2 are to be inserted between other carriers being conveyed in the main way 1, is adjacent to the wheels 31 and 41 which drive the auxiliary chains 3 and 4 and are respectively mounted for vertical rotation.

Figure 3:
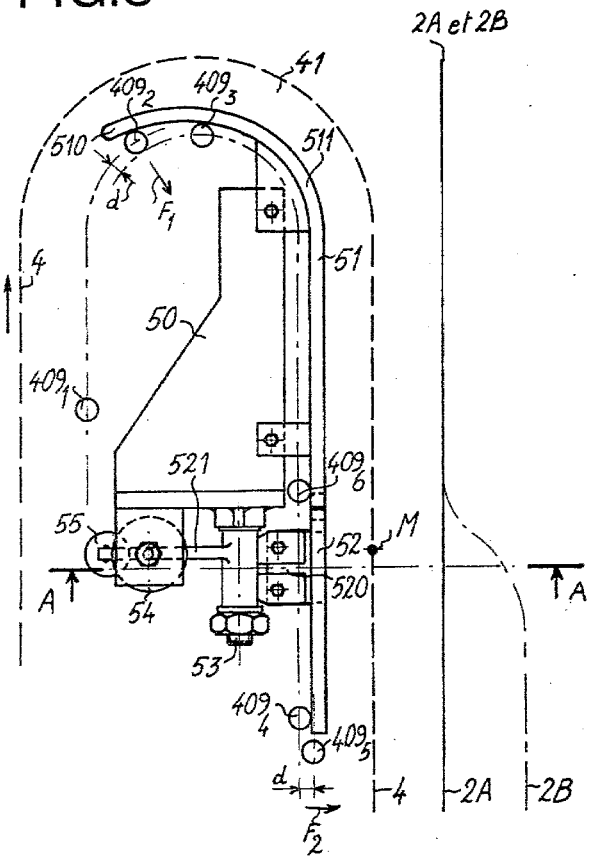
FIG. 3 is a top view of the first electromechanical transfer device.
Figure 4:
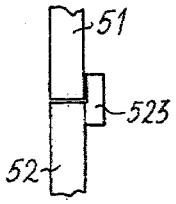
FIG. 4 is a side view showing details of the stationary and movable roller slopes in the first electromechanical transfer device.

Referring to FIG. 3, the first transfer device 5 comprises a frame 50 secured to the conveyor skeleton and two slopes on which the rollers 409 of the lugs roll down. The two slopes are mounted on the frame 50 and are adapted to engage or disengage the lugs 40. One slope 51 is stationary and has a curved portion 510 adapted to move the lugs 40 in the horizontal direction of arrow $F_1$ towards the interior of the loop on the first auxiliary chain 4, along a distance d such that lugs 40 conveyed by the chain 4 in the engaged position, i.e. adapted to push the carrier bodies, come into the retracted or disengaged position at the beginning of the other regular part 511 of the stationary slope 51 which is parallel to the chain 4. The other slope 52 is movable and has a right-angle section 520, the vertical side of which is a downward prolongation of the stationary slope 51 when lugs 40 are retracted. The horizontal side of the movable slope 52 is rotatably mounted around a stationary horizontal shaft 53. The end 521 of the movable slope 52 opposite the right-angle portion with respect to shaft 53 co-operates with a vertically moving plunger core 540 of an electromagnet 54, via a small horizontal pivot 542 to which a counter-weight 55 is secured.

Figure 5A:
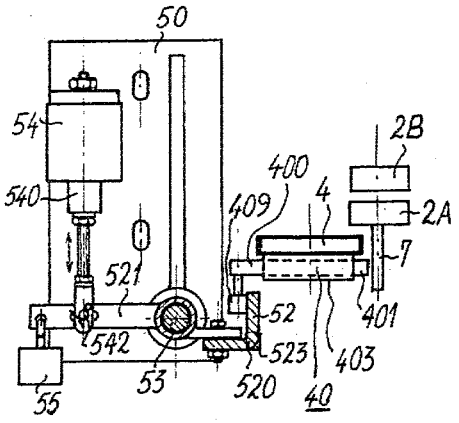
FIGS. 5A and 5B are front views of the first electromechanical transfert device showing two positions of the movable roller slope, one corresponding to the disengagement and the other corresponding to the engagement of a retractable lug on the first auxiliary chain.

As shown in FIG. 5A, when the control device associated with the first transfer device 5 has not received information regarding the transfer of a carrier, the electromagnet 54 secured to the frame 50 is not energized. In such cases, the roller 409 of each lug 40, conveyed at the engaged position $409_1$ by the first auxiliary chain 4, is first progressively disengaged between the end positions $409_2$ and $409_3$ of the curved portion 510 of the stationary slope 51 and then remains disengaged from position $409_3$ to position $409_4$ at the downstream end of the movable slope 52. In this condition, the vertical parts of the slopes 51 and 52 are horizontally aligned and form a continuous runway for the rollers 409, which are pressed by the return force of the associated springs 406. Accordingly, the movable slope 52 abuts the bottom portion of the stationary slope 51 via a projection 523 and as a result of the counter-weight 55, as shown in detail in FIG. 4. When a carrier C has previously been driven by the secondary chain 2B and is stopped at the waiting position M by a leaf spring acting as a retractable abutment (not shown) it cannot be pushed by the ends 401 of the retracted lugs 40, as shown in FIG. 5A. After the retracted position $409_4$ the lugs 40 return to the engaged position $409_5$ by extending their springs 406 in the direction of arrow $F_2$ opposite to $F_1$, in a manner corresponding to the position $409_1$.

Figure 5B:
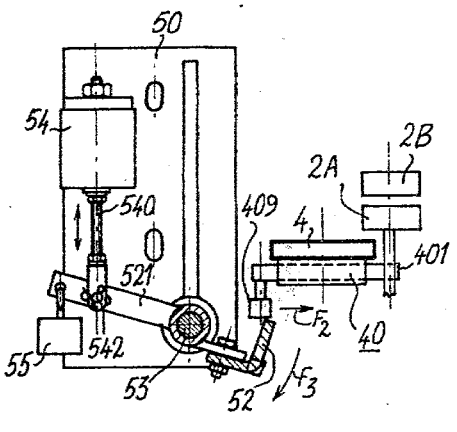

On the other hand, as shown in FIG. 5B, the electromagnet 54 is energized on reception of information regarding transfer from the secondary way 2 to the main way 1. The plunger core 540 rotates the movable slope 52 around the shaft 53, so that the roller runway formed by the vertical side of the end 520 of the movable slope 52 pivots downwards in the direction of arrow $F_3$. As shown in FIG. 3, the roller 409 of a retracted lug 40 in the position $409_6$ does not continue to move along slope 52 when it reaches the downstream end of the stationary slope 51, at the rear of the carrier body C. The associated spring 406 pushes the lug body 400 into the engaged position and the annular cross-member 410 abuts the lug slideway 403. The lug becomes engaged upstream of the carrier C at the waiting position M and drives it towards the main way 1.

We shall now describe the second transfer device 6 which controls the transfer of the carriers from the main way 1 to the secondary way 1. The device 6 is diagrammatically shown in FIGS. 6, 7 and 8 and comprises two assemblies 7 and 8. The mechanical assembly 7 is adapted to stop carriers which move down the runway portion 20A, as shown in FIG. 1. The electromechanical assembly 8 is adapted to inject each carrier in front of a stationary lug on the secondary chain 2B on the runway 2A. The two assemblies 7 and 8 co-operate mechanically and are mounted on a frame 60 secured to the conveyor skeleton.

Figure 6:
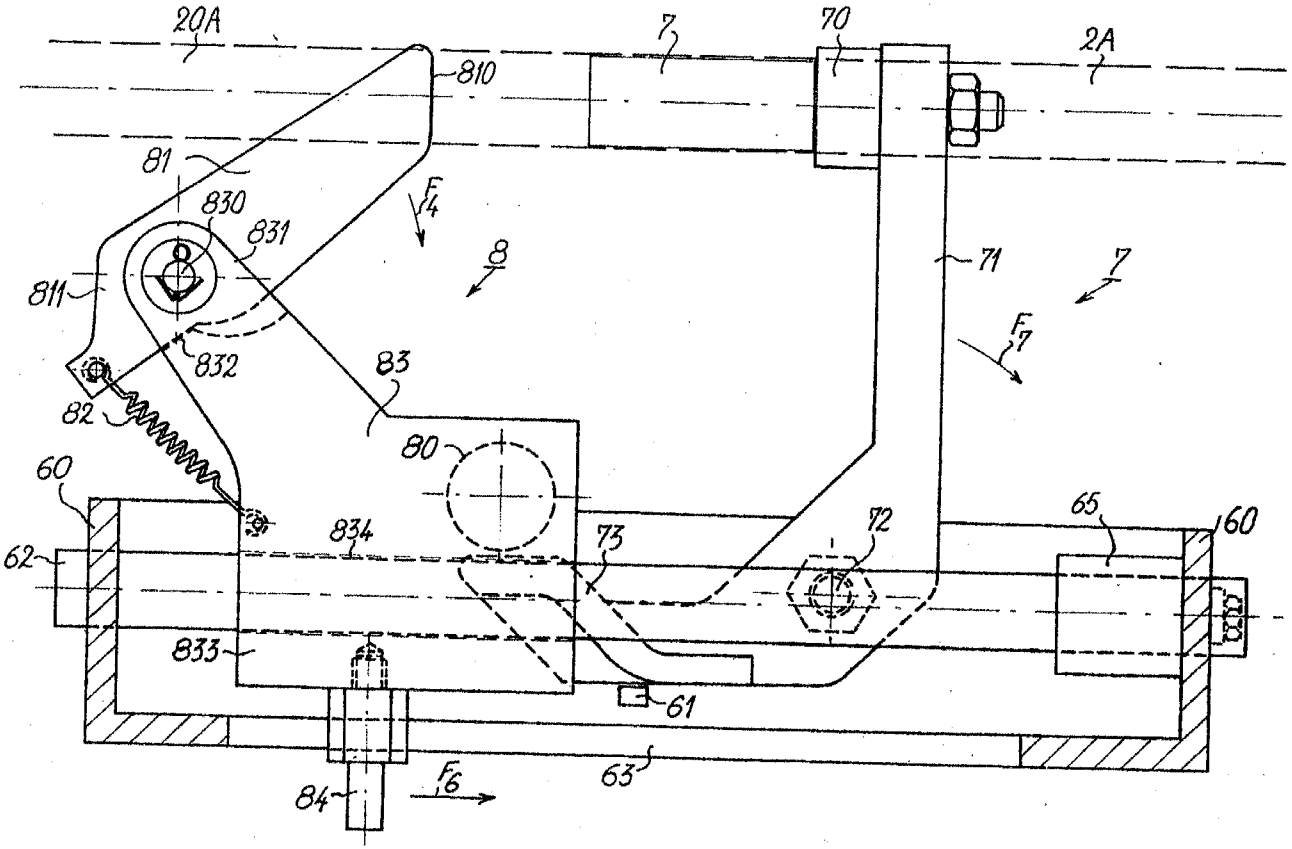
FIGS. 6, 7 and 8 respectively are top, back and side views, partly in section, of the second electromechanical transfer device when inoperative.

The mechanical assembly 7 comprises a rubber shock-absorbing stop 70 which, when inoperative as shown in FIG. 6, is positioned in the path of the carrier body C. The stop 70 is rigidly secured to one end of a right-angled horizontal holder 71, the angular portion of which is rotatably mounted around a vertical stationary shaft 72 secured to the frame 60. The other end of the holder 71 has a vertical surface portion 73 along which a roller 80 of the other assembly 8 can move. In the inoperative position, the vertical front portion of the surface portion 73 abuts a projection 61 of the frame 60.

The mechanical part of the electromechanical assembly 8 comprises a push-rod 81 having a front end 810 which, when inoperative, is positioned along the path followed by the carriers down runway 20A under the rearward return action of a spring 82. The spring 82 is secured to the rear end 811 of the push-rod 81. The rear end 811 is mounted for rotation around a vertical shaft 830 between the arms of the U-shaped end 831 of a horizontal holder 83 which has a bottom 832 forming an abutment. The base 833 of the holder 83 has a bore 834 through which a horizontal longitudinal shaft 62 extends and is secured to the frame 60. The lower surface of the base 833 abuts the roller 80. In the initial positions shown in FIG. 6, the roller 80 is substantially in contact with the vertical surface portion 73 and prevents the holder 71 of the stop 70 from rotating around the shaft 72.

A transverse horizontal stud 84 is rigidly secured at the side of the holder 83 and extends through a groove 63 in the frame 60.

Figure 7:
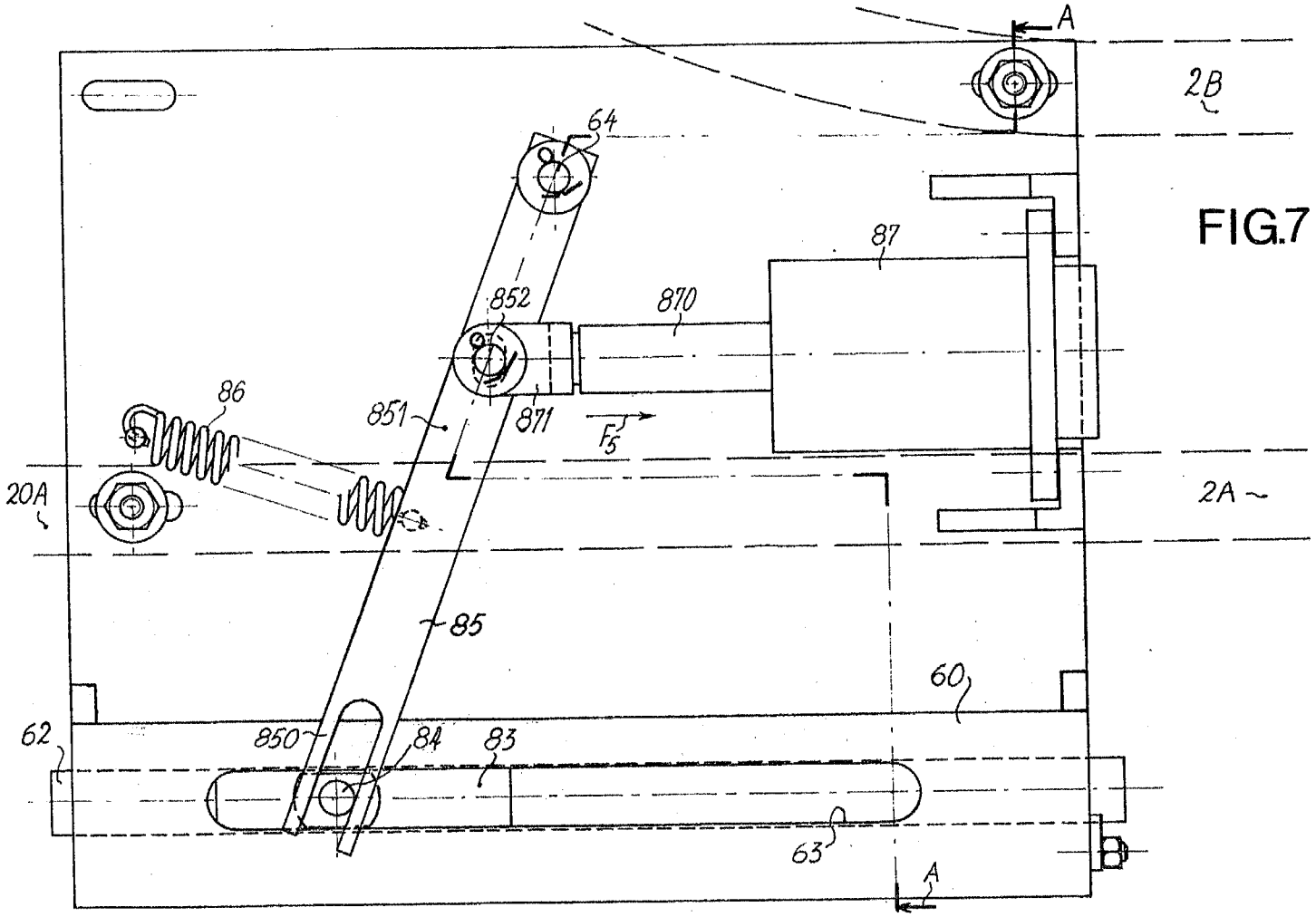
Figure 8:
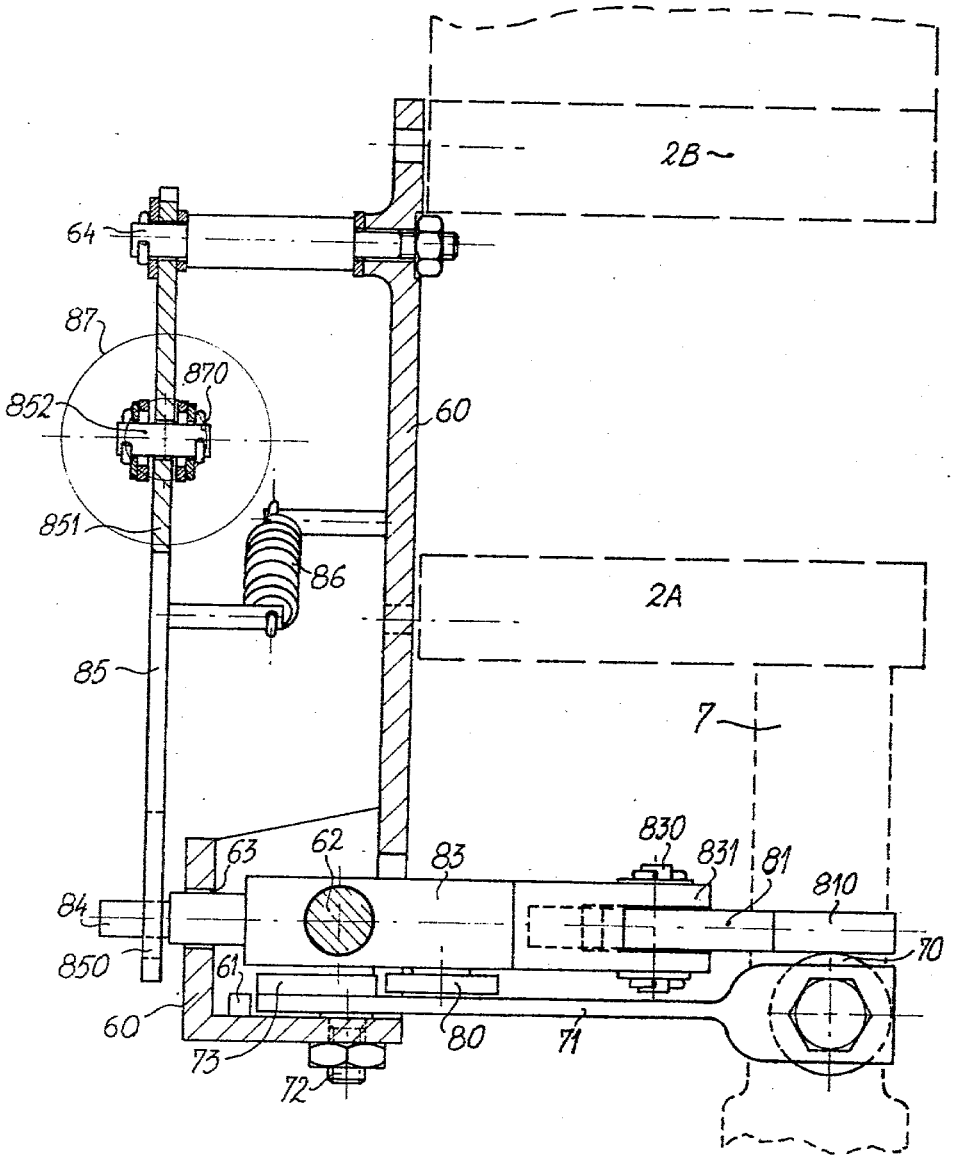

As shown in FIGS. 7 and 8, an arm 85 is rotatably mounted around a top horizontal shaft 64 secured to the frame 60. The arm 85 has a bottom U-shaped end 850 or a suitable recess surrounding the stud 84. The central part 851 of the arm 85 is pulled by a spring 86 secured to the frame 60 and can be driven by the plunger core 870 of an electromagnet 87. The end 871 of the plunger core 870 is formed with an oblong aperture receiving a shaft 852 which is secured to the central part 851 of the arm 85.

The assemblies 7 and 8 of the second transfer device 6 have been shown in FIGS. 6 to 8 in the inoperative position, i.e. in the absence of a carrier or in the presence of a carrier abutting the stop 70.

The operation of the second transfer device 6 is described hereinafter.

When a carrier is released by the second auxiliary chain 3 and descends by gravity down the runway 20A, the carrier body C pivots the push rod 81 around the shaft 830 in the direction of arrow $F_4$ and abuts the stop 70. Next, the push-rod 81 returns to its initial position behind the carrier body C under the return action of the spring 82, as shown in FIG. 6. When the electric control devices associated to the second transfer device 6 receive a signal for transferring the carrier to the secondary way 2, the electromagnet 87 is energized so that the plunger core 870 is attracted in the direction of the arrow $F_5$ shown in FIG. 7, and drives by means of the arm 85 pivoting around the shaft 64 the holder 83 to slide along the shaft 62 in the direction parallel to the carrier motion, as shown in FIG. 6 by the arrow $F_6$. After the holder 83 has moved a short distance, the roller 80 leaves the vertical surface portion 73, so that the stop holder 71 pivots around the stationary shaft 72 in the direction of the arrow $F_7$ shown in FIG. 6 and the stop 70 is simultaneously released from the front of carrier body C. Thus, the continuous motion of the push-rod holder 83 helps to push the carrier C, via the push-rod 81, which completely releases the stop 70; the carrier is accurately conveyed between two stationary lugs on the secondary chain 2B, the rear lug driving the carrier along the secondary runway 2A. At the end of its travel, the push-rod holder 83 strikes an annular rubber buffer 65 which is coaxial with the shaft 62.

When the electromagnet 87 is switched off, the various components of the second transfer device 6 are returned to their initially-defined positions by the return force of the spring 86 which returns the push-rod holder 83, and by returning of the roller 80 which pushes the vertical surface portion 73 against the projection 61 and thus moves the stop 70 back into line with the path of the carriers.

Although the invention has been described with reference to an ambodiment, its scope is limited only by the accompanying claims. More particularly, the first and second transfer devices can be inserted at suitable places in a conveyor, different from the places shown in FIG. 1.

What I claim is:

1. A carrier conveyor comprising:

a main runway including a main chain to which are secured stationary lugs for continuously driving carriers on said main runway;

a bidirectional secondary runway including a secondary chain to which are secured stationary lugs for continuously driving carriers on said secondary runway;

a first auxiliary runway including a first auxiliary chain arranged to be moved in synchronism with said main chain and having retractable lugs for driving carriers from a waiting position of said secondary runway to said main runway, said first auxiliary runway further including lug returning means for each lug of said first auxiliary chain, said lug member having a returning spring to being the lug into an engaged position for driving the carrier;

a second auxiliary runway including a second auxiliary chain arranged to be moved in synchronism with said main chain and having lugs for driving carriers from said main runway to a stop position on said second auxiliary runway which stop position is located upstream of said secondary runway;

a first electromechanical transfer means for transferring a carrier from said waiting position of said secondary runway onto the runway of said first auxiliary runway by means of an engaged lug of said first auxiliary chain, said first electromechanical means comprising movable means located in the region of said waiting position for selectively disengaging said retractable lugs of said first auxiliary chain from the path followed by said carriers when no carrier is to be transferred from said secondary runway to said main runway wherein a retractable lug at the disengaged position is not in contact with the carriers at said waiting position;

a second electromechanical transfer means for transferring a carrier from said stop position of said second auxiliary runway to said secondary runway, said second electromechanical means comprising pivotable stopping means for stopping at a carrier previously driven by said second auxiliary chain at the stop position; and said second electromechanical transfer means further comprising a retractable slidable means which is in the path followed by the carrier upstream of said stop position, said retractable slidable means being effective to push a stop carrier into said secondary runway between two stationary lugs on said secondary chain while simultaneously disengaging said pivotable stopping means.

2. A carrier conveyer according to claim 1, in which said transferring electromechanical means further comprise stationary mechanical means having a stationary shaft, this means being located upstream of said waiting position for disengaging said retractable lugs of said auxiliary chain from said path followed by said carriers, and movable disengaging means which are located downstream of said stationary disengaging means, said movable disengaging means including pivot means and being adapted to prolong the time for disengagement of said stationary disengaging means when no carrier is to be transferred by pivoting around said stationary shaft for engaging a retractable lug to drive a carrier when said carrier is to be transferred.

3. A carrier conveyor according to claim 2, in which said movable disengaging means includes an electromagnet for controlling the pivoting movement of said movable disengaging means.

4. A carrier conveyor comprising:

a main runway including a main chain to which are secured stationary lugs for continuously driving carriers on a main runway;

a secondary runway including a secondary chain to which are secured stationary lugs for continuously driving carriers on a secondary runway;

an auxiliary runway including an auxiliary chain arranged to be moved in synchronism with said main chain and having retractable lugs for driving carriers from a waiting position of said secondary runway to said main runway, each lug of said auxiliary chain comprising a returning spring to an engaged position for driving a carrier; and an electromechanical means for transferring a carrier from said waiting position of said secondary runway onto the runway of said first auxiliary runway by an engaged lug of said auxiliary chain, said electromechanical means comprising movable means located in the region of said waiting position for selectively disengaging said retractable lugs of said auxiliary chain from the path followed by said carriers when no carrier is to be transferred from said secondary runway to said main runway, and a retractable lug at the disengaged position being not in contact with carriers at said waiting position.

5. A carrier conveyor comprising:

a main runway including a main chain to which are secured stationary lugs for continuously driving carriers on said main runway;

a secondary runway including a secondary chain to which are secured stationary lugs for continuously driving carriers on said secondary runway;

an auxiliary runway including an auxiliary chain fitted with retractable lugs arranged to be moved in synchronism with said main chain, said retractable lugs being adapted for driving carriers from a waiting position of said secondary runway to said main runway, said auxiliary runway including retracting means comprising a roller and a returning spring for each lug of said auxiliary chain to bring each lug to an engaged position for driving the carrier;

a stationary slope which is located upstream of said waiting position on which the rollers of said retractable lugs roll down, said stationary slope comprising at least a curved part adapted for disengaging said retractable lugs of said auxiliary chain from an engaged position to a disengaged position;

a movable slope located in the region of said waiting position which is parallel to the path followed by said carriers, said movable slope prolonging the time for downstream travel by said rollers on said stationary slope when no carrier is to be transferred from said secondary runway to said main runway so that said retractable lugs are at said disengaged position in said region of said waiting position and then return to said engaged position by the spring action of said returning spring at the downstream end of said movable slope, said movable slope being disengaged from the path followed by the rollers so that a retractable lug is returned at the engaged position by the returning spring at the upstream end to drive a carrier from the waiting position to the main runway; and electromechanical transfer means for moving said movable slope between the position prolonging the time for travel on said stationary slope and the position for disengagement.

6. A carrier conveyor according to claim 5, including mounting means for said movable slope and stationary shaft whereby said movable slope is rotatably mounted around said stationary shaft along an axis which is parallel to the paths followed by the rollers of said retractable lugs and of said carriers in said waiting position.

7. A carrier conveyor according to claim 6, including an electromechanical control means, said electromechanical control means comprising an electromagnet having a movable core and an articulated pivot, the core being secured to said pivot, and further including articulation means fixed to said movable slope.

8. A carrier conveyor comprising:

a main runway including a main chain to which are secured stationary lugs for continuously driving carriers on said main runway;

a secondary runway including a secondary chain to which are secured stationary lugs for continuously driving carriers on said secondary runway;

an auxiliary runway including an auxiliary chain arranged to be moved in synchronism with said main chain and having lugs for driving carriers from said main runway to a stop position of the auxiliary runway upstream of said secondary runway; and an electromechanical transfer means for transferring a carrier from said stop position of said auxiliary runway to said secondary runway, said electromechanical transfer means comprising retractable sliding means, stopping means and pivotable means which serve to stop a previously driven carrier which has been driven by said auxiliary chain, said retractable sliding along the path followed by the carriers upstream of said stop position and for pushing said stopped carrier into said secondary runway between two stationary lugs of said secondary chain being retractable therefrom, and simultaneously pushing and disengaging said pivotable stopping means from said path followed by said carrier.

9. A carrier conveyor according to claim 8, in which said stopping means comprises a stationary shaft, a rotatable holder, mounting means and a stop secured to said holder pivotable about said shaft and in which said slidable means includes pushing means in the form of a push-rod returned by said spring along the path to said holder, said holder being rotatably mounted on said push-rod and being slidable parallel to the path followed by the carriers; said push-rod holder further comprising a roller which holds said stop holder in abutting when no carrier is to be transferred from the stop position to the secondary runway and which is progressively detached from the stop holder when the push-rod pushes a carrier onto the secondary runway so that the stop holder pivots around the stationary pivoting axis to release the stop from the carrier path.

10. A carrier conveyor according to claim 9, including an electromagnet in which said push-rod holder slides under the control of said electromagnet.

11. A carrier conveyor according to claim 8, in which said carriers after being driven by said auxiliary chain descend by gravity down an inclined portion of said auxiliary runway to the stop position.

* * * * *